United States Patent [19]

Tsubokawa et al.

[11] Patent Number: 4,724,586

[45] Date of Patent: Feb. 16, 1988

[54] WATER-RESISTANT SLIDE FASTENER AND METHOD OF MANUFACTURING THE SAME

[75] Inventors: Yoshitoki Tsubokawa, Kurobe; Koichi Tanikawa, Toyama, both of Japan

[73] Assignee: Yoshida Kogyo K.K., Tokyo, Japan

[21] Appl. No.: 561,342

[22] Filed: Dec. 14, 1983

[30] Foreign Application Priority Data

Dec. 14, 1982 [JP] Japan ..... 57-218913

[51] Int. Cl.[4] ..... A44B 19/00

[52] U.S. Cl. ..... 24/384; 24/389

[58] Field of Search ..... 24/384, 389, 396

[56] References Cited

U.S. PATENT DOCUMENTS

| | | | |
|---|---|---|---|
| 2,910,754 | 11/1959 | Morin | 24/384 |
| 3,501,816 | 3/1970 | Heimberger | 24/389 |
| 3,764,437 | 10/1973 | Heimberger | 24/389 X |
| 3,922,760 | 12/1975 | Matsuda | 24/395 X |
| 4,042,735 | 8/1977 | Yoneya | 24/389 X |
| 4,276,680 | 7/1981 | Moertel | 24/389 X |
| 4,502,190 | 5/1985 | Inamura | 24/389 |

FOREIGN PATENT DOCUMENTS

| | | | |
|---|---|---|---|
| 182027 | 4/1936 | France | 24/389 |
| 1453103 | 9/1966 | France | 24/389 |

*Primary Examiner*—Peter A. Aschenbrenner

*Attorney, Agent, or Firm*—Hill, Van Santen, Steadman & Simpson

[57] ABSTRACT

A water-resistant slide fastener has a pair of water-resistant transversely stretchable stringer tapes having reinforced marginal edge portions, respectively, each including an elastically deformable core tape, and a pair of rows of coupling elements mounted on the reinforced marginal edge portions, respectively, and engageable with each other across a central axis. The reinforced marginal edge portions have a pair of confronting edges projecting toward each other beyond the central axis when the rows of coupling elements are out of mutual engagement. Each of the stringer tapes has a woven or knitted foundation tape and a soft sealing layer on the foundation tape. Each of the reinforced marginal edge portions includes a folded marginal tape edge portion with the soft sealing layer disposed outside. The core tape is sandwiched between the folded marginal tape edge portion and a major portion of one of the stringer tapes.

3 Claims, 8 Drawing Figures

WATER-RESISTANT SLIDE FASTENER AND METHOD OF MANUFACTURING THE SAME

BACKGROUND OF THE INVENTION

1. Field of the Invention:

The present invention relates to a water-resistant slide fastener for use on an article such as a ski wear or a sports bag requiring protection against entrance of rain, sleet or snow, and a method of manufacturing such a water-resistance slide fastener.

2. Description of the Prior Art:

Slide fasteners for use on outer garments and other articles designed for outdoor activities do not require a high degree of resistance against penetration of water. There has been a demand for such water-resistant slide fasteners that are relatively simple in construction, can be mass-produced, and are inexpensive to manufacture.

One known water-resistant slide fastener is manufactured, as disclosed in U.S. Pat. No. 3,501,816, by affixing a row of coupling elements to a slide fastener stringer tape, and then coating a sealing material on the elements and the stringer tape with a coating device. The conventional method is disadvantageous in that the manufacturing process is complex, needs to be implemented by a large-scale apparatus, and fails to achieve satisfactory product quality and cost as products tend to be defective due to uneven coating of the sealing material. The slide fasteners manufactured by the prior process have the danger of forming a gap between seals when the stringer tape is subjected to a large transverse pull.

SUMMARY OF THE INVENTION

It is therefore an object of the present invention to provide a water-resistant slide fastener which is of relatively simple construction, is less costly to manufacture, and ensures a satisfactory water-resistant capability even when a large lateral pull is imposed on the slide fastener.

Another object of the present invention is to provide a method of manufacturing durable water-resistant slide fasteners through a simple process and without employing any newly devised apparatus.

According to the present invention, there is provided a water-resistant slide fastener including a pair of water-resistant transversely stretchable stringer tapes each composed of a foundation tape and a soft sealing layer and having reinforced marginal edge portions, respectively, each composed of a folded marginal tape edge portion and an elastically deformable core tape sandwiched between the folded marginal tape edge portion and a major stringer tape portion, and a pair of rows of coupling elements mounted on the reinforced marginal edge portions, respectively, and engageable with each other across a central axis. The reinforced marginal edge portions have a pair of confronting edges projecting toward each other beyond the central axis when the rows of coupling elements are out of mutual engagement. For manufacturing such a water-resistant slide fastener, the rows of coupling elements and the core tapes are sewn to the stringer tapes, and then the marginal tape edge portions are folded back over the core tapes and bonded thereto with the soft sealing layers disposed outside.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
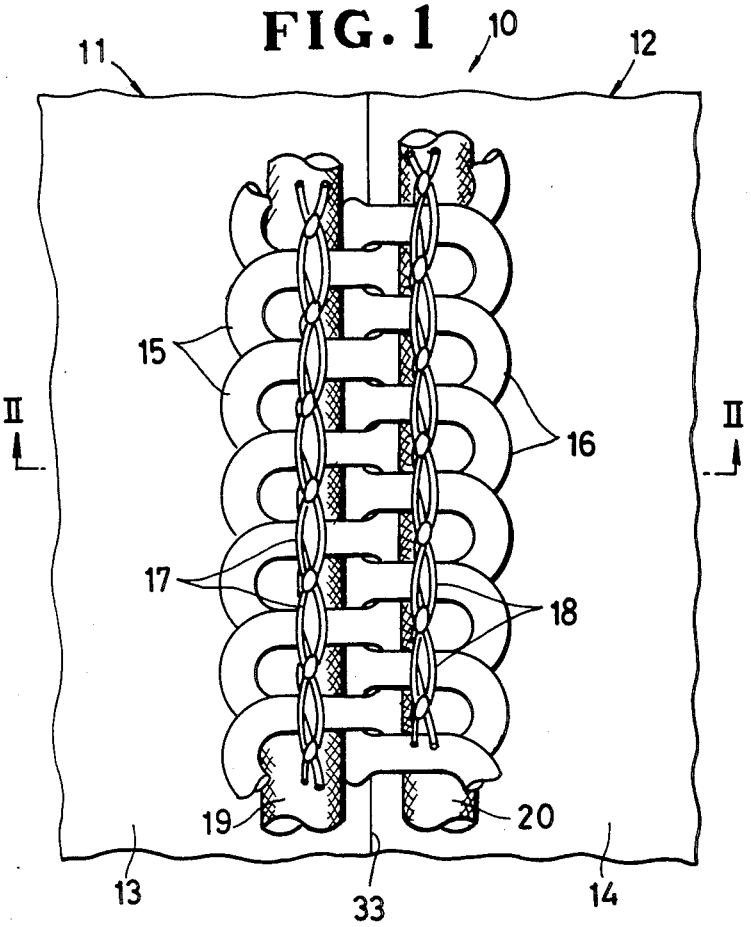
FIG. 1 is a fragmentary plan view of a water-resistant slide fastener according to the present invention.
Figure 2:
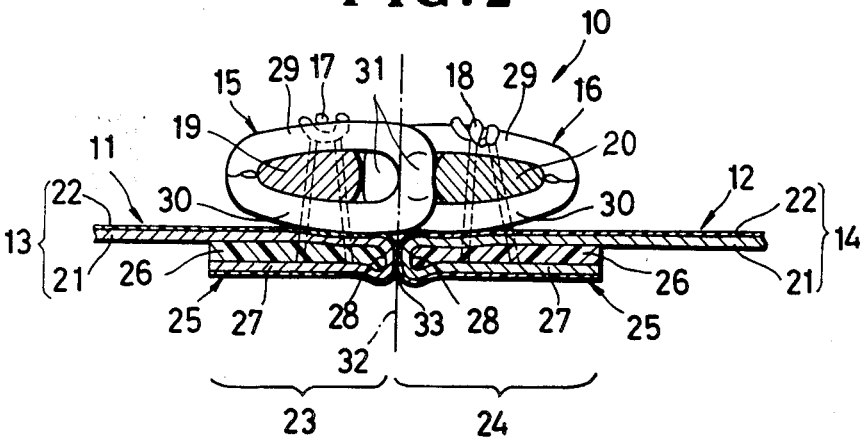
FIG. 2 is an enlarged cross-sectional view taken along line II—II of FIG. 1.

The principles of the present invention are particularly useful when embodied in a water-resistant slide fastener generally designated by the reference numeral 10 in FIGS. 1 and 2.

The water-resistant slide fastener 10 comprises a pair of fastener stringers 11, 12 composed of a pair of stringer tapes 13, 14 supporting at their confronting longitudinal edges a pair of rows of helically coiled coupling elements 15, 16, respectively, sewn by sewing stitches 17, 18 penetrating a pair of elongate reinforcing cores 19, 20 extending through the helically coiled coupling elements 15, 16.

Figure 3:
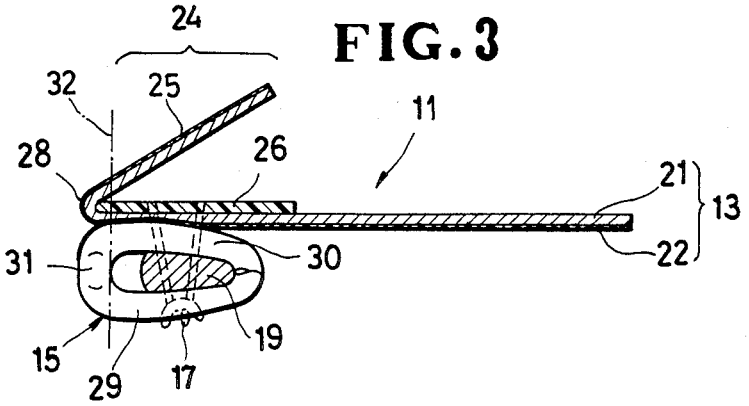
FIG. 3 is a transverse cross-sectional view illustrative of the manner in which a folded tape edge is bonded to a stringer tape.

As shown in FIG. 2, each of the stringer tapes 13, 14 comprises a foundation tape 21 woven with elastic weft threads or knitted so that it is transversely stretchable. The foundation tape 21 is coated on at least one surface thereof with a soft sealing layer 22 of synthetic rubber or soft synthetic resin. Therefore, the stringer tapes 13, 14 are laterally stretchable and resistant to passage of water therethrough. The pair of stringer tapes 13, 14 includes a pair of reinforced longitudinal marginal edge portions 23, 24, respectively, each composed of a marginal tape edge portion 25 folded onto the major portion of the stringer tape, as illustrated in FIG. 3, with the sealing layer 22 disposed outside. A resilient core tape 26 is sandwiched between the folded marginal edge portion 25 and the major portion of the stringer tape. The core tape 26 is made of synthetic rubber or synthetic resin. A folded margin 27 of the foundation tape 21 is coextensive with the reinforced marginal edge portion 25 and is bonded to the core tape 26 by an adhesive or a thermoplastic film (not shown) placed between the foundation tape's margin 27 and the core tape 26 and fused with heat and pressure. The reinforced marginal edge portions 23, 24 of the stringer tapes 13, 14 are thicker than the rest of the stringer tapes 13, 14 and support the rows of coupling elements 15, 16 respectively on the sealing-layer side of the respective stringer tape 13, 14. The reinforced marginal edge portions 23, 24 have confronting edges 28, 28 that will be elastically deformed on abutment against each other when the rows of coupling elements 15, 16 are interengaged as shown in FIG. 2.

Figure 4:
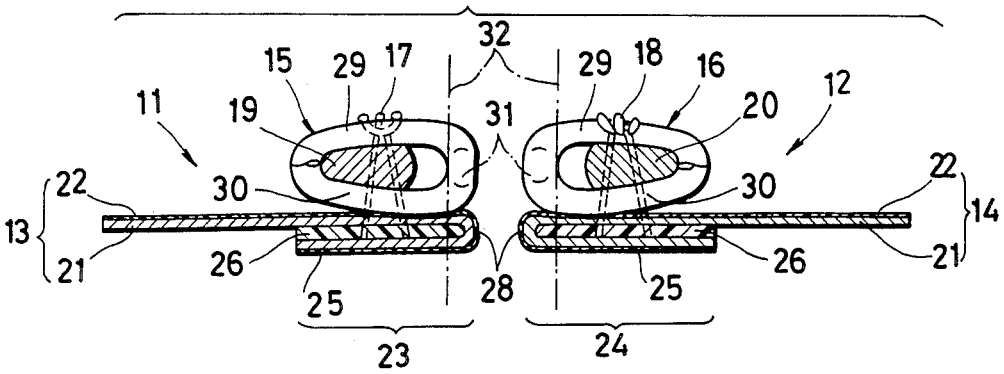
FIG. 4 is a transverse cross-sectional view of the water-resistant slide fastener of FIG. 1, showing disengaged rows of coupling elements.

In FIGS. 2 and 4, each of the coupling elements 15, 16 comprises an upper leg 29, a lower leg 30 spaced from the upper leg 29, and a coupling head 31 extending between the upper and lower legs 29, 30. The reinforcement core 19, 20 is disposed between the upper and lower legs 29, 30 in transversely spaced relation to the coupling head 31. The coupling elements 15, 16 are mounted on the stringer tapes 13, 14, respectively, with the lower legs 30 held directly against the stringer tapes 13, 14. The sewing stitches 17, 18 are in the form of double locked stitches formed by two needles and one looper (described below) and passing through the reinforcement cores 19, 20, the respective major portions of the stringer tapes 13, 14, and the core tapes 26, 26.

When the opposed rows of coupling elements 15, 16 are interengaged, as shown in FIG. 2, the coupling heads 31, 31 are located past each other across a central vertical axis 32 of engagement between the rows of coupling elements 15, 16. When the rows of coupling elements 15, 16 are disengaged, as illustrated in FIG. 4, the confronting edges 28, 28 of the stringer tapes 13, 14 lie substantially flush with the coupling heads 31, 31, respectively, and project toward each other beyond the central vertical axis 32.

The stringer tapes 11, 12 are water-resistant against passage of water such as rain water therethrough, and the confronting edges 28, 28 are pressed against each other when the rows of coupling elements 15, 16 are interengaged, thereby preventing water such as rain water from passing through a seam-like joint 33 between the contronting edges 28, 28. Since the stringer tapes 11, 12 are transversely stretchable, any lateral force tending to pull the stringer tapes 11, 12 apart from one another is substantially taken up by the stringer tapes 11, 12 and is not directly imposed on the coupling elements 15, 16. Furthermore, the coupling elements 15, 16 mounted on the reinforced marginal edge portions 23, 24 are effectively protected from becoming positionally unstable under such lateral force. Accordingly, the confronting edges 28, 28 remain firmly pressed against each other, ensuring good water-resistant capability. The water-resistant slide fastener 10 is relatively simple in construction and has substantially the same appearance as that of ordinary slide fasteners. Therefore, it can be used on articles such as garments, bags and other personal items.

Figure 5:
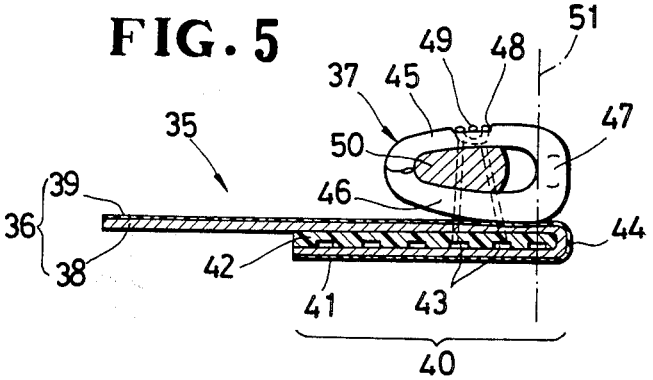
FIG. 5 is a transverse cross-sectional view of one stringer of a water-resistant slide fastener according to another embodiment of the present invention.

FIG. 5 shows a slide fastener stringer 35 constructed according to another embodiment of the present invention. The slide fastener stringer 35 comprises a water-resistant stringer tape 36 composed of a woven or knitted foundation tape 38 with a sealing layer 39. The stringer tape 36 has a reinforced marginal edge portion 40 including a folded marginal edge portion 41 with a knitted core tape 42 sandwiched between the major portion of the stringer tape 36 and the folded marginal edge portion 41, the knitted core tape 42 having a plurality of parallel longitudinal interwale grooves 43. A row of helically coiled coupling elements 37 is mounted on the reinforced marginal edge portion 40. Each of the coupling elements 37 comprises an upper leg 45, a lower leg 47, and a coupling head 46, the upper leg 45 having a recess 48. The coupling elements 37 are sewn to the reinforced marginal edge 40 by sewing threads 49 received in the recess 48 in the upper leg 45 and extending through a reinforcing core 50 disposed through the coupling elements 37. The sewing threads 49 also penetrate the stringer tape 36 and the knitted core tape 42 where they are received in some of the interwale grooves 43. The reinforced marginal edge portion 40 has an edge 44 projecting transversely beyond a vertical axis 51 of engagement between opposite rows of coupling elements and lying substantially flush with the coupling head 47. According to the embodiment shown in FIG. 5, the coupling element 37 is retained on the stringer tape 36 more firmly and stably since the sewing threads 49 have portions received in the recess 48 in the upper leg 45 and the interwale grooves 43.

A method of manufacturing the water-resistant slide fastener 10 shown in FIGS. 1 through 4 is described as follows in connection with FIGS. 6A through 6C.

A jig for holding slide fastener components while sewing the coupling elements 15, 16 to the stringer tapes 13, 14 comprises a lower plate 55 and an upper plate 56 placed over the lower plate 55. A pair of loopers 57, 58 for guiding looper threads (not shown) is disposed below the lower plate 55, and two pairs of needles 59, 60 and 61, 62 for guiding needle threads (not shown) are disposed above the upper plate 56. The lower plate 55 has a pair of transversely spaced grooves 63, 64 located above the loopers 57, 58, respectively, and a pair of needle holes 65, 66 communicating with the grooves 63, 64, respectively. The upper plate 56 has a pair of transversely spaced grooves 67, 68 and a pair of needle holes 69, 70 communicating respectively with the grooves 63, 64. The pairs of needles 59, 60 and 61, 62 are vertically aligned with the needle holes 69, 70, respectively. The lower plate 55 has on its upper surface a central ridge 71 positioned between the grooves 63, 64 and held against a lower surface of the upper plate 56. The grooves 63, 64 in the lower plate 55 are a little closer than the grooves 67, 68 in the upper plate 56 to the central ridge 71.

Figure 6A:
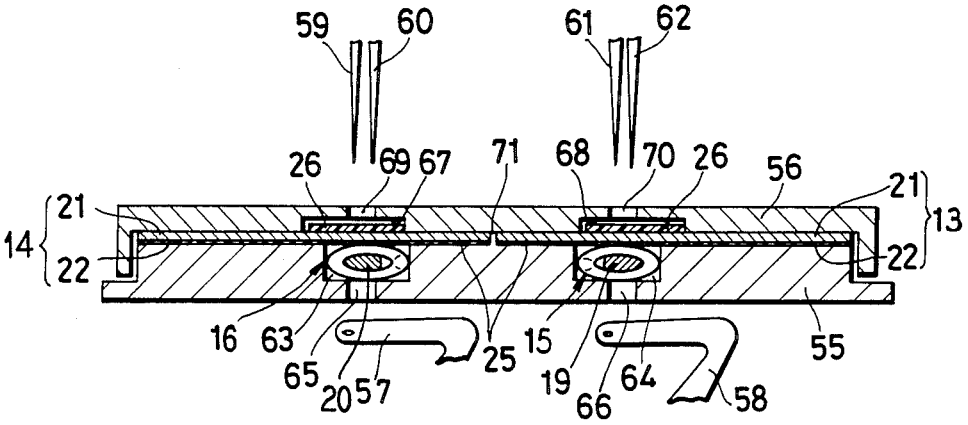
FIGS. 6A through 6C are transverse cross-sectional views showing progressive steps of manufacturing the water-resistant slide fastener of FIG. 1.

In operation, as shown in FIG. 6A, the rows of coupling elements 16, 15 with the reinforcing cores 19, 20 inserted therein are disposed respectively in the grooves 63, 64 in the lower plate 55. The stringer tapes 13, 14 are sandwiched between the upper and lower plates 56, 55 with the sealing layers 22 held in contact with the lower plate 55 and confronting edges of the marginal edge portions 25, 25 of the tapes 13, 14 being held against the ridge 71. The core tapes 26 are received respectively in the grooves 67, 68, respectively. Since the grooves 63, 64 are closer than the grooves 67, 68 to the ridge 71, the coupling elements 15, 16 are located slightly more closely than the core tapes 26 to the ridge 71. The coupling elements 15, 16 and the core tapes 26 are sewn to the stringer tapes 13, 14 by unnumbered double locked stitches while the coupling elements 15, 16, the core tapes 26, and the stringer tapes 13, 14 are being fed along in a direction normal to the sheet of the drawings. The coupling elements 15, 16 are now securely mounted on the sealing layer 22, while the core tapes 26 are securely mounted on the foundation tapes 21, leaving the marginal edge portions 25, 25 of the stringer tapes 13, 14 one on each side of the ridge 71.

Figure 6B:
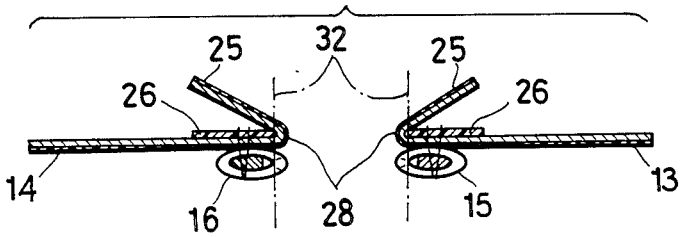
Figure 6C:
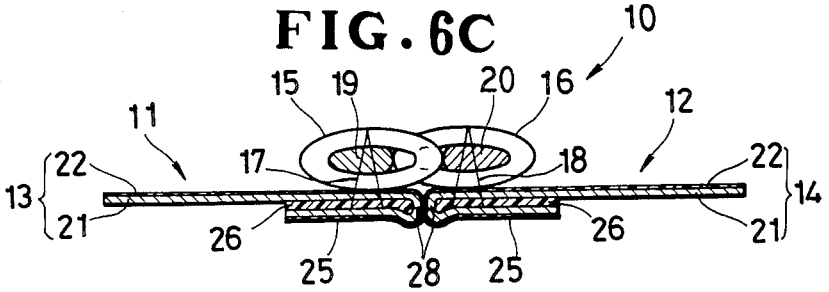

Then the marginal edge portions 25 of the stringer tapes 13, 14 are folded back around edges of the respective core tapes 26 over the latter as shown in FIG. 6B. The folded marginal edge portions 25 and the core tapes 26 are bonded to each other by an adhesive, or joined with an adhesive film sandwiched and fused therebetween with heat and pressure. The bonded marginal edge portions 25 close the apertures made in the core tapes 26 by the sewing threads 17, 18, thus preventing water from finding its way through the stringer tapes 13, 14 through such apertures.

As shown in FIG. 6B, the edges of the core tapes 26 around which the marginal edge portions 25 are folded back are positioned slightly beyond the central axis 32 of engagement. Therefore, the confronting edges 28 of the stringer tapes 13, 14 project beyond the central axis 32.

The method of making the water-resistant slide fastener 10 is primarily composed of three relatively simple steps, i.e. the step of securing the coupling elements to the stringer tapes, the step of folding back the marginal edge portions of the stringer tapes, and the step of bonding the folded marginal edge portions. Therefore, the water-resistant slide fastener 10 can easily be manufactured highly efficiently and inexpensively. The water-resistant slide fastener 10 thus manufactured through the simple process is stable and durable in use.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A method of manufacturing a water-resistant slide fastener, comprising the steps of:

(a) positioning a pair of transversely stretchable water-resistant stringer tapes in confronting edge-to-edge relation, each of said stringer tapes including a foundation tape and a soft sealing layer thoroughly covering one surface of said foundation tape;

(b) securing a pair of elastically deformable core tapes to said stringer tapes, respectively, on the respective foundation tapes thereof in transversely spaced relationship from confronting longitudinal edges of said stringer tapes to thereby provide a pair of marginal edge portions of said stringer tapes between said core tapes;

(c) sewing a pair of rows of continuous coupling elements by sewing threads to said stringer tapes, respectively, on the respective sealing layers thereof in transversely spaced relationship from said confronting longitudinal edges of said stringer tapes, said rows of coupling elements being disposed slightly more closely than said core tapes, said sewing being such that said sewing threads extend through both each said stringer tape and each said core tape secured to the latter;

(d) folding back said marginal edge portions over said core tapes, respectively, to thereby provide a pair of confronting edges engageable with each other when said rows of coupling elements are interengaged with each other across a longitudinal plane which bisects said slide fastener at a central axis thereof and which is perpendicular to the general plane of said slide fastener, said confronting edges of said stringer tapes projecting beyond said longitudinal plane when said rows of coupling elements are disengaged; and (e) bonding said folded marginal edge portions to said core tapes, respectively.

2. A water-resistant slide fastener comprising:

(a) a pair of transversely stretchable water-resistant stringer tapes having reinforced marginal edge portions, respectively, each of said stringer tapes including a foundation tape and a soft sealing layer of synthetic rubber thoroughly covering one surface of said foundation tape, each of said reinforced marginal edge portions including (1) a folded tape edge portion with said soft sealing layer disposed outside, and (2) an elastically deformable core tape of synthetic rubber sandwiched between said tape edge portion and a major portion of each said stringer tape and bonded to each said stringer tape, (b) a pair of rows of continuous coupling elements mounted on said reinforced marginal edge portions, respectively, and having coupling heads interengageable with each other across a longitudinal plane which bisects said slide fastener at a central axis thereof and which is perpendicular to the general plane of said slide fastener, each of said rows of coupling elements being disposed on said soft sealing layer of said major portion of each said stringer tape, said reinforced marginal edge portions having a pair of confronting edges projecting toward each other beyond said longitudinal plane when said rows of coupling elements are disengaged; and (c) sewing threads securing said rows of coupling elements respectively to said reinforced marginal edge portions, said sewing threads having portions penetrating said major portion of each said stringer tape and each said core tape with the folded edge portion covering said threads.

3. A water-resistant slide fastener according to claim 2, said confronting edge of each said reinforced marginal edge portion in its free position lying flush with the ends of said coupling heads of a respective one of said coupling element rows when disengaged.

* * * * *